US005368366A

United States Patent [19]

Mizelle

[11] Patent Number: 5,368,366

[45] Date of Patent: Nov. 29, 1994

[54] SHALLOW PROFILE LEGREST AND FURNITURE

[76] Inventor: Ned W. Mizelle, P.O. Box 5985, High Point, N.C. 27262

[21] Appl. No.: 26,049

[22] Filed: Mar. 5, 1993

[51] Int. Cl.[5] ..... A47C 7/50

[52] U.S. Cl. ..... 297/423.3; 297/85

[58] Field of Search ..... 297/69, 85, 89, 423.25, 297/423.26, 423.30

[56] References Cited

U.S. PATENT DOCUMENTS

| | | | |
|---|---|---|---|
| 3,492,049 | 1/1970 | Fletcher | 297/89 X |
| 4,570,996 | 2/1986 | Rogers, Jr. | 297/85 |
| 4,861,101 | 8/1989 | Hartline | 297/69 |
| 5,054,850 | 10/1991 | Pine | 297/89 X |

FOREIGN PATENT DOCUMENTS

| | | | |
|---|---|---|---|
| 803673 | 10/1958 | United Kingdom | 297/85 |
| 1442338 | 7/1976 | United Kingdom | 297/89 |

*Primary Examiner*—Peter R. Brown
*Attorney, Agent, or Firm*—Beveridge, DeGrandi, Weilacher & Young

[57] ABSTRACT

An article of furniture has a mechanism for supporting an extendible legrest. The mechanism includes a fixed bracket mounted near the front rail of the furniture frame, an upper rear link connected to the fixed bracket at a first pivot in front of the front rail, a lower rear link connected to the fixed bracket at a second pivot under the front rail, an upper front link connected to the upper rear link at a third pivot, and a lower front link connected to the lower rear link at a fourth pivot which is lower than the third pivot. A movable legrest bracket is connected to the upper front link at a fifth pivot, and is also connected to the lower front link at a sixth pivot. The sixth pivot is lower than the fifth pivot when the movable legrest bracket is at its stored position. The upper front link is connected to the lower rear link at a seventh pivot which is lower than the third pivot and is between the second and fourth pivots. Two such mechanisms are connected together by torsion members so they extend and retract simultaneously, and these torsion members are housed in a space beneath the front rail when the mechanism is in its retracted position.

43 Claims, 6 Drawing Sheets

2
12
4'
30
8
14
16
28
38
50
4
6
10

SHALLOW PROFILE LEGREST AND FURNITURE

BACKGROUND OF THE INVENTION

This invention relates to extendible legrests and to upholstered articles of furniture which are provided with such legrests.

Extendible legrests are well known in the furniture industry. They are particularly popular in recliners where such a legrest is supported by a series of four bar linkages for movement between a retracted or stored position where it is vertically oriented at the front of the furniture frame and a leg-supporting extended position where it is generally horizontal and spaced from the furniture frame.

Existing extensible legrest mechanisms are incompatible with many popular types of furniture. For example, furniture units with sofa sleeper mechanisms are generally not provided with extensible legrests because of space constraints. Within the normal dimensions of such pieces of furniture, there is inadequate space to accommodate both the mattress/deck assembly of the sleeper unit, and the mechanical components of an extendible legrest assembly. The configurations of legrest mechanisms are often not compatible with the spaces available in sleeper furniture frames, and various components of legrest mechanisms would interfere with normal operation of sleeper mechanisms.

In one previous proposal disclosed in U.S. Pat. No. 4,861,101, an upholstered piece of furniture with a sleeper mechanism is combined with an extendible legrest mechanism. This prior patent discloses a sleeper unit with a shallow legrest assembly which, excepting the drive mechanism, is mounted forwardly of the front rail of the furniture frame. All pivots in the legrest support linkages are positioned forwardly of the front rail. The drive mechanism is mounted inside the arm, and it drives one of the forward links in a forward direction. Due to the fact that the forward links inherently travel a greater distance than the rear links, the drive mechanism of U.S. Pat. No. 4,861,101 has an output stroke of substantial length.

The present invention relies in part on the discovery that a more effective mechanism is made possible by utilizing a partial front rail, and by positioning some components of the mechanism in the space which lies below the bottom surface of the front rail. The present invention also utilizes a different and improved interconnection between the four-bar linkages which support the legrest from the furniture frame. These and other aspects of the invention will be set forth in greater detail subsequently in this specification.

SUMMARY OF THE INVENTION

The invention involves improvements to a basic type of mechanism for supporting an extendible legrest, wherein the mechanism is movable between a retracted position where the legrest is in a substantially vertical stored position and an extended position where the legrest is in a generally horizontal leg-supporting position. A fixed bracket is mountable near the front surface of the furniture frame. The legrest is mounted on a movable member which occupies a substantially vertical stored position near the fixed bracket when the mechanism is in its retracted position. The movable member occupies a generally horizontal leg-supporting position spaced from the fixed bracket when the mechanism is in its extended position. An upper rear link is connected to the fixed bracket at a first pivot; a lower rear link is connected to the fixed bracket at a second pivot which is lower than the first pivot; an upper front link is connected to the upper rear link at a third pivot; and a lower front link is connected to the lower rear link at a fourth pivot which is lower than the third pivot. The movable member which carries the legrest is connected to the upper front link at a fifth pivot and is connected to the lower front link at a sixth pivot. The sixth pivot is lower than the fifth pivot when the movable member is at its stored position. To reduce the depth of the mechanism when retracted, the links have profiles which are generally vertical and overlap each other lengthwise when the mechanism is in its retracted position.

According to one primary improvement of the present invention, the first pivot of the basic mechanism is positioned more forwardly than the second pivot. The front rail provides the front surface of the furniture frame; the first pivot is positioned in front of the front rail; and, the second pivot is positioned under the front rail.

Another primary improvement of the present invention involves the arrangement whereby, in a basic mechanism described above, the upper front link is pivotally connected to the lower rear link at a seventh pivot which is lower than the third pivot. The seventh pivot is located between the second and fourth pivots.

According to a further primary improvement, a piece of furniture includes two of the basic mechanisms which are connected by a lateral torsion member so they extend and retract together; and, when the mechanisms are in their retracted positions, the torsion member is located under the bottom surface of a front rail of the furniture frame when the mechanisms are in their retracted positions.

There are numerous secondary features of the invention which are possibly known per se, but are important features of the invention when taken in combination with the abovementioned primary improvements. These secondary features are described in the following paragraphs of this Summary.

The lower rear link has an upper section and a lower section. The upper section lies under the front rail when the movable member is in its stored position, and the lower section is positioned more forwardly than the front rail when the movable member is in its stored position.

When the movable member is in its stored position, the third and fourth pivots are positioned more forwardly than the first and second pivots, thus providing some assurance that the mechanism will not lock up in the stored position and that it will unfold properly when actuated to do so.

A drive link is connected to one of the rear links to pivot the connected rear link in a forward direction to drive the mechanism to a position where the movable member is at its leg-supporting position. Preferably, the drive link is connected to the lower rear link, and it extends below the first and second pivots to permit use of the mechanism in T-cushion furniture.

A spring is provided for moving the drive link in a forward direction, thus driving the mechanism to a position where the movable member is at its leg-supporting position. A lever is connected to the spring and to the drive link. The lever may be pivotally mounted on a mounting bar which extends rearwardly from the fixed bracket. The lever is movable from a locking position where it prevents the spring from driving the drive link to a releasing position where it permits the spring to move the drive link in the forward direction. The lever can be movable from its locking position to its releasing position by a manually operated means. A preferred manually operated means includes a handle which is movable through a given angle of travel. A lost motion connection is provided between the handle and the lever so the handle moves the lever during only a portion of the lever's given angle of travel.

The geometry of the mechanism is such that it is locked in its extended leg-supporting position to prevent downward movement of the movable member when downward forces are exerted on the movable member rearwardly of a given vertical plane. Conversely, the mechanism is unlockable in response to downward forces exerted on the movable member forwardly of the given vertical plane, thus permitting movement of the movable member to its stored position.

The invention also pertains to the complete item of furniture, i.e. an upholstered piece of furniture including a mechanism of the basic type which has one or more of the primary improvements of the invention. Such an upholstered piece of furniture may have a folded mattress and a folded mattress support in a cavity of the furniture frame, arranged so that the mattress support and the mattress are unfoldable to provide a bed for sleeping.

Persons familiar with the field of the invention will realize that there are other significant features in the disclosed mechanisms.

DETAILED DESCRIPTION

Figure 1:
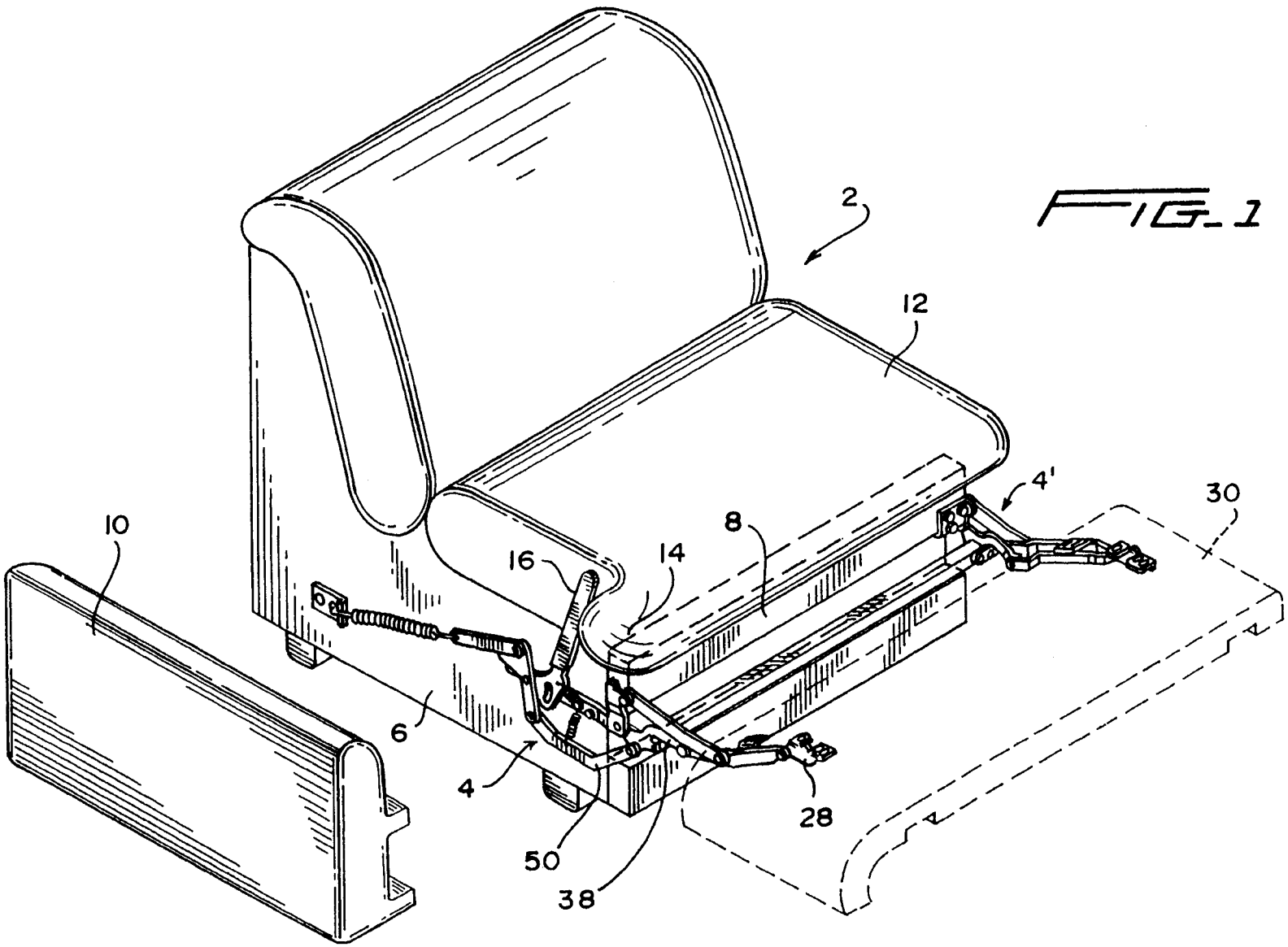
FIG. 1 is a partially exploded view of a T-cushion sectional unit, with some components removed for convenience of understanding.

FIG. 1 shows a right-end sectional unit 2 provided with two legrest mechanisms 4 and 4'. The mechanism 4 is mounted on the right side 6 of the frame of the unit, and the mechanism 4' is mounted on the front rail 8 of the frame. When in normal use, the arm 10 is attached to the right side 6, so the handle 16 of the mechanism 4 will lie between the arm 10 and the right edge of the seat cushion 12. The cushion itself has a laterally extending projection 14 at its forward edge as is conventional in T-cushion furniture. It will be noted that, except for the handle 16, the mechanism 4 is located entirely lower than this lateral projection 14 and below the bottom plane of the seat cushion 12 in order to provide optimum flexibility in designing furniture of aesthetically suitable characteristics.

The mechanism 4 is operated by the handle 16, the upper end of which is approximately at the same height as the upper surface of the seat cushion 12 when the furniture is unoccupied. When an occupant sits down, the cushion is compressed to the extent that the upper end of the handle is exposed for manual operation. As will be understood later in this specification, rearward pivotal movement of the handle 16 will actuate the mechanism to move it to the position shown in FIG. 1 where the mechanism is extended and the legrest is in its leg-supporting position. As will be described subsequently, the mechanisms 4 and 4' are connected together by the legrest and two other torsion members so that extension of the right mechanism 4 will result in a similar extension of the left mechanism 4'. Likewise, the mechanisms 4 and 4' will be simultaneously retracted.

Figure 2:
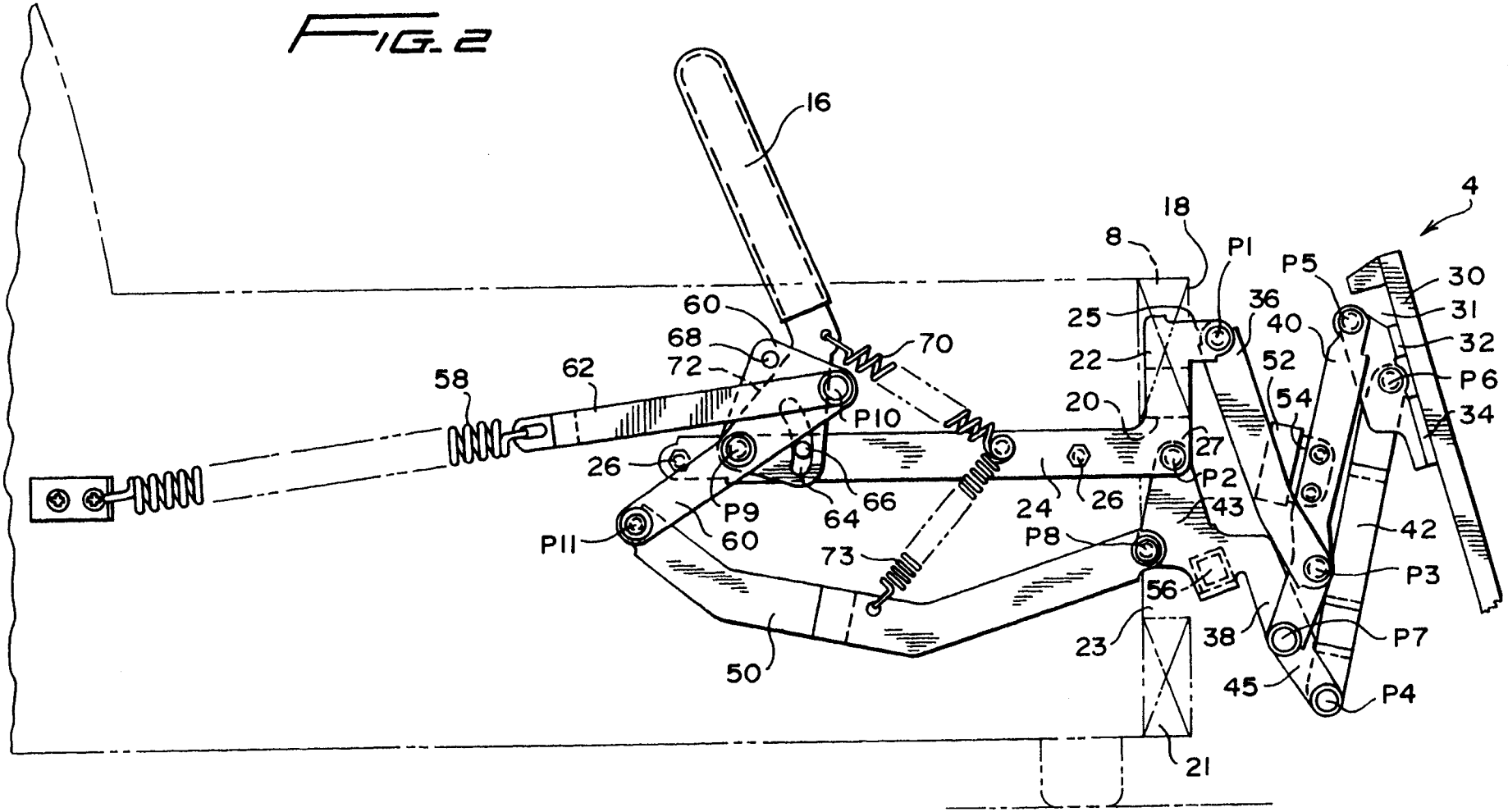
FIG. 2 is a side view of the apparatus, showing the components at an intermediate position which lies between the extended and retracted positions of the mechanism.
Figure 3:
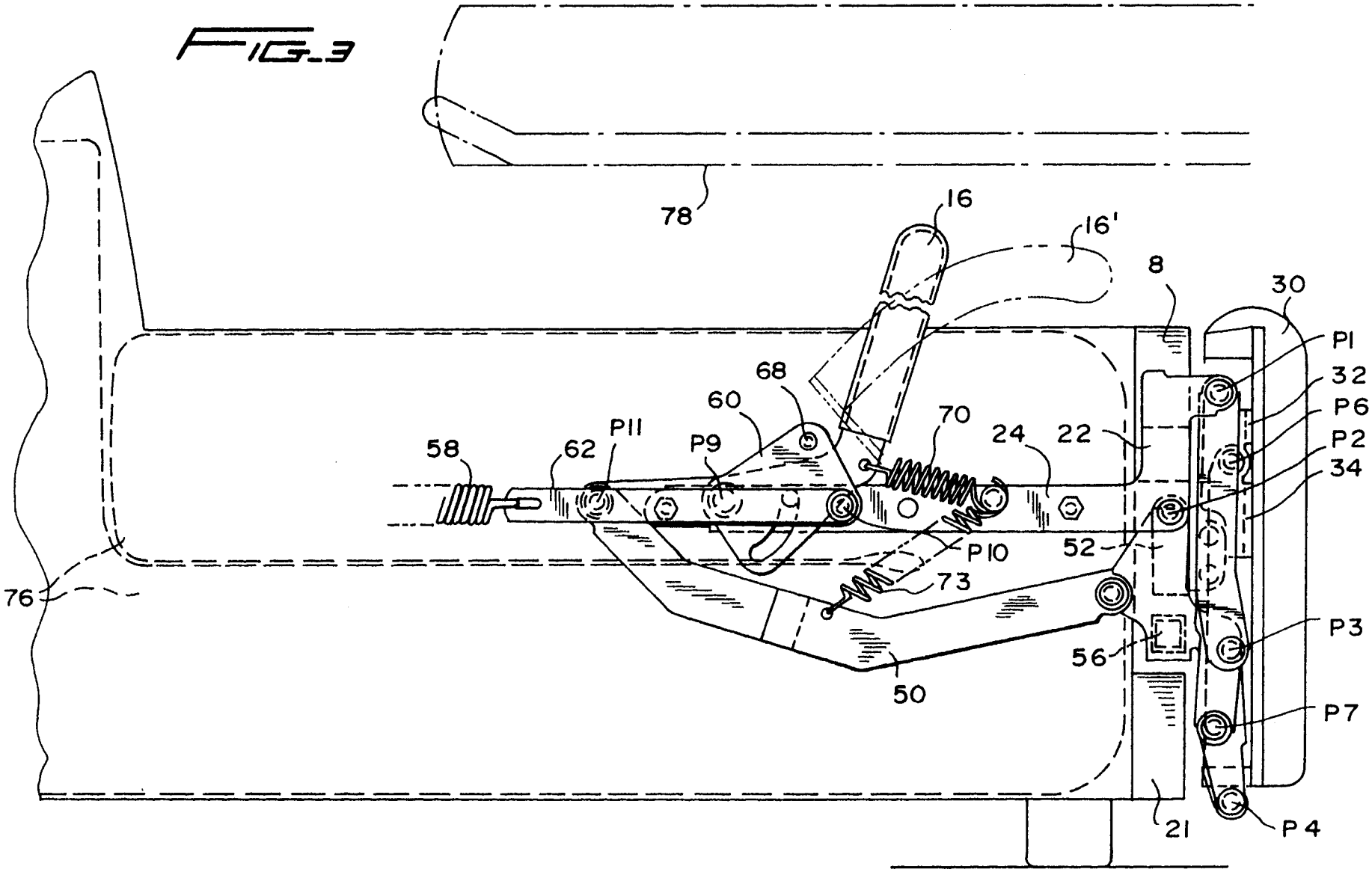
FIG. 3 is a view similar to FIG. 2, but showing the mechanism in its retracted position, where the legrest is in its stored position.
Figure 4:
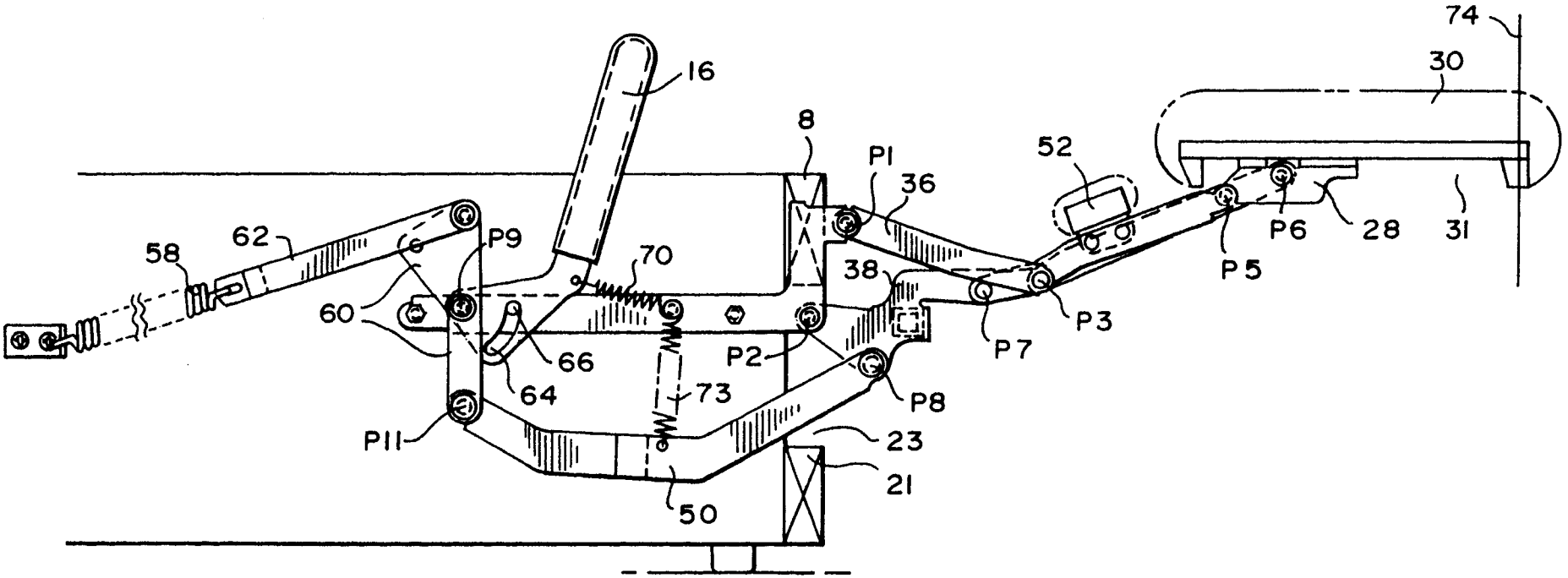
FIG. 4 is a view similar to FIG. 2 but showing the mechanism in its extended position, where the legrest is in its leg-supporting position.

The profiles of the elements of the mechanism are shown in FIGS. 2–4. In this specification, the term "profile" is used to describe the shape of the surface of a component as seen in such side views. As can be seen in FIG. 2, the front rail 8 of the unit frame has a front surface 18 and a bottom surface 20. The frame may also have a lower front rail 21 which is separated from the rail 8 to define a space 23. A fixed bracket 22 is mounted near the front surface by a mounting bar 24 which is integral with and extends rearwardly from the bracket and is fastened to the right panel 6 of the unit frame by bolts 26 which are threaded into T nuts (not shown). The bracket 22 includes two vertical flanges 25 and 27 which are laterally, vertically and forwardly offset from each other and are connected together by a horizontal flange 29.

Figure 5:
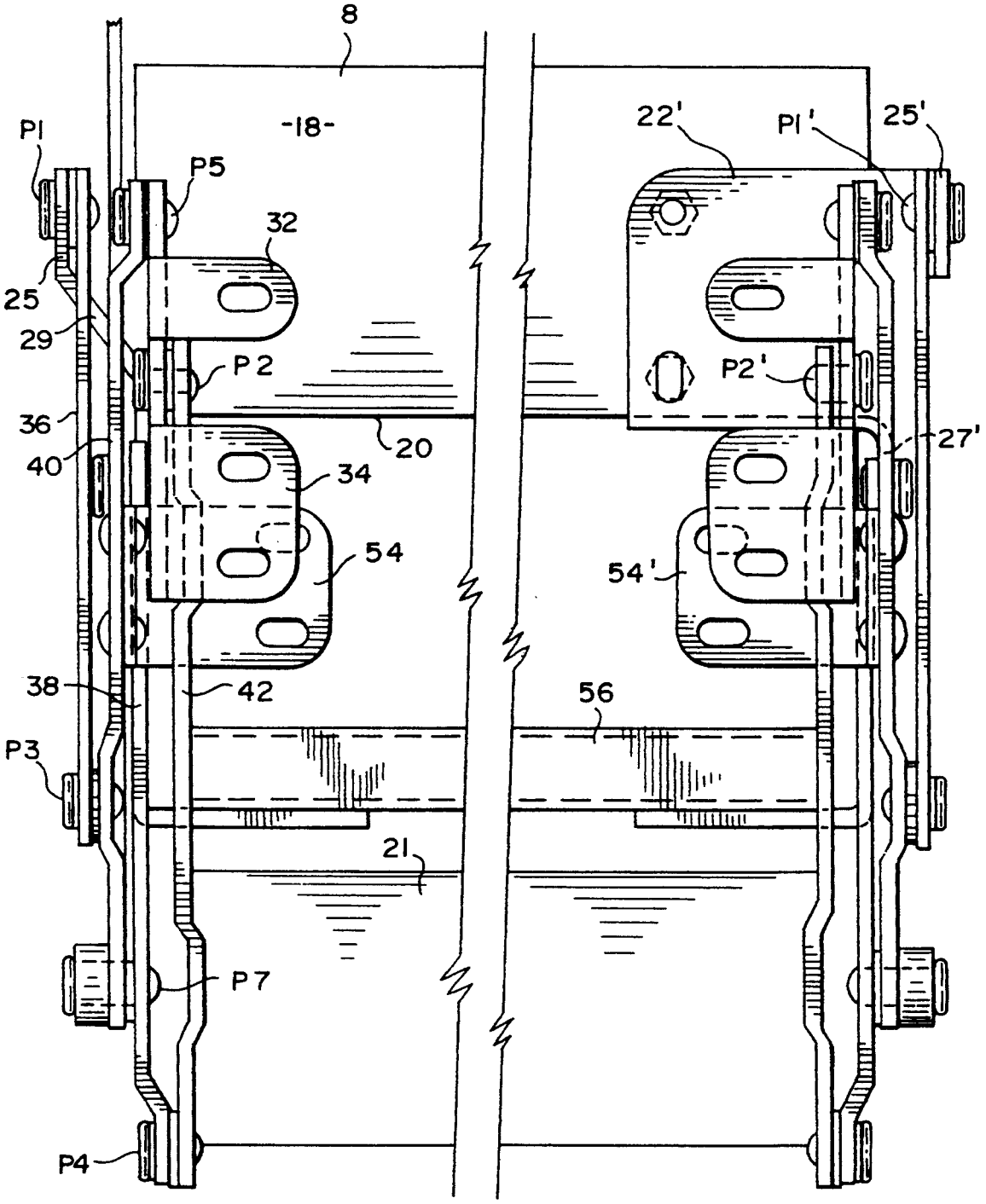
FIG. 5 is a front view of the mechanism in its retracted position.

At the outboard end of the mechanism 4 a movable member, legrest mounting bracket 28, is fastened to the legrest 30. The flanges for achieving this are shown at 32 and 34 in FIG. 5. The legrest has a rear cavity 31 which accommodates the various links when the mechanism is in the retracted position shown in FIG. 3.

The movable legrest mounting bracket 28 is connected to the fixed mounting bracket 22 by two interconnected four-bar linkages which include an upper rear link 36, a lower rear link 38, an upper front link 40, and a lower front link 42.

The link 36 is pivotally connected to flange 25 of the fixed bracket 22 at a first pivot P1. The link 38 is pivotally connected to the flange 27 of fixed bracket 22 at a second pivot P2 which is lower than, rearward of, and laterally offset from the pivot P1. The flange 27 and the link 40 lie in and define the same vertical plane. The upper front link 40 is pivotally connected to the link 36 at a third pivot P3, and the lower front link 42 is pivotally connected to the lower rear link 38 at a pivot P4 which is lower than the pivot P3. The movable legrest bracket 28 is connected to the upper front link 40 at pivot P5, and it is connected to the lower front link 42 at a sixth pivot P6 when the movable legrest bracket 28 is at its stored position shown in FIG. 3. Pivot P6 is lower than P5 and, in their retracted positions, the profiles of the links 36, 38, 40, and 42 overlap lengthwise and are generally vertical. However, their front and rear edges are not laterally aligned so their profiles are not horizontally coextensive.

The pivots P1, P2, P3 and P4 define one four-bar linkage, and the pivots P3, P4, P5 and P6 define another four-bar linkage.

According to one feature of the invention, the pivot P1 is positioned more forwardly than the pivot P2. As can be seen in FIG. 2, the pivot P1 is positioned in front of the front rail 8 which defines the front surface of the frame; and, the pivot P2 is positioned in the space 23 under the front rail 8. This makes it possible to provide a mechanism which is more stable and controllable than if the pivot P2 were forward of the plane of the front of the front rail.

As can be seen in FIG. 3, the lower rear link has an upper section 43 which lies under the front rail 8 and a lower section 45 which is positioned more forwardly than the front rail when the movable member is in its stored position.

According to another feature of the invention, the link 40 is pivotally connected to the lower rear link 38 at a seventh pivot P7 which is lower than the third pivot P3. As can be seen best in FIG. 2, the pivot P7 is located between pivots P2 and P4 on the lower rear link 38.

The left legrest mechanism 4' is substantially a mirror image of the right mechanism 4 except for the fixed mounting bracket 22' which is bolted to the front surface of the frame rather than to the side surface thereof. The bracket 22' has a vertical flange 44 which lies flat against the front surface of the front rail 8, a flange 25' which extends forwardly from flange 44 to receive a pivot P1' which corresponds to the pivot P1 of the right side mechanism, a horizontal flange 46 which extends below and lies against the bottom surface of the front rail 8, and a lower flange 27' which projects downwardly from the flange 46 and carries the pivot P2' which corresponds functionally to the pivot P2 of the right side mechanism.

Referring again to FIGS. 2–4, it will be seen that the legrest mechanism 4 is driven to the extended position by a drive link 50 which has its forward end pivotally connected to the lower rear link 38 at P8. The right side mechanism is connected to the left side mechanism by the legrest 30 itself, by a laterally extending supplemental legrest 52 bolted to flanges 54 and 54' on the upper forward links 40 and 40', and by a square tube 56 which is attached to flanges on the, lower rear links 38 and 38'. These members 30, 52, and 56 act as torsion members in the respect that they transmit forces from the right mechanism 4 to the left mechanism 4' so that these two mechanisms move simultaneously between the extended and retracted positions. As can be seen in FIG. 3, the torsion members 52 and 56 are located in the space 23 under the bottom surface 20 of the front rail 8 when the mechanisms 4 and 4' are in their retracted positions. This is an important feature of the invention as it contributes to the overall compactness of the mechanism.

The drive link 50 has a relatively short stroke so it can be driven directly by a manually operated lever. However, it is preferable in many situations to use a spring assisted actuating mechanism of the type shown in FIGS. 1–4.

The drive link 50 extends below the axes of pivots P1 and P2 in order to permit use of the mechanism in T-cushion furniture. It is moved in a forward direction by a spring 58. The spring 58 is connected to the drive link 50 by a lever 60 which is pivotally mounted on the mounting bar 24 at P9. One end of the lever 60 is connected to the spring by a link which is pivotally connected to the lever at P10. The other end of the lever 60 is connected at pivot P11 to the rear end of the drive link 50. When the legrest mechanism is retracted and the lever 60 is at the position shown in FIG. 3, the lever 60 is at a locking position where it prevents the spring 58 from driving the drive link 50. A manually operated means, preferably the handle 16 also pivotally mounted at P9, is provided to move the lever from its locking position to a releasing position where the lever permits the spring 58 to move the drive link 50 in a forward direction.

The handle is movable through a given angle of travel, approximately 55 degrees, established by an arcuate slot 64 which receives a stationary stop pin 66 on the mounting bar 24. A tension spring 70 biases the handle 16 in a clockwise direction so that it occupies the position shown in solid lines except when it is moved rearwardly by an occupant.

There is a lost motion connection between the handle 16 and the lever 60 so that the handle moves the lever only during a portion of the handle's given angle of travel. Referring to FIG. 2, it will be noted that there is a stop 68 on the remote face of the lever, and this stop lies in the path of travel of the rear edge 72 of the handle. Therefore, when the handle 16 starts its rearward movement, the rear edge 72 bears against the stop member 68, causing the lever 60 to turn in a direction which is counterclockwise as seen in FIG. 2. At some point, the longitudinal axis of the spring 58 will travel over center with respect to the pivot P9, so that the spring will sustain the counterclockwise movement of the lever, thus forcing the drive link 50 forwardly, and causing the mechanism to move from its retracted position to its extended position. The action of the spring can be assisted by manual forces exerted on the handle 16 especially in situations where there is friction or other impediments to the free extension of the legrest mechanism.

A spring 73 extends between the mounting bar 24 and the drive link 50. When at the orientation shown in FIG. 4 the spring 73 tends to hold the drive link in its forward extended position until such time that the occupant presses down on the forward portion of the legrest to commence the movement of the mechanism to the restricted position.

It is advantageous to connect the drive link 50 to one of the rear links 36 or 38 rather than to one of the forward links 40 or 42. This is because significantly less travel of the drive link 50 is required, particularly if it is connected to the lower rear link 38.

A potential risk of driving one of the rear links of a mechanism of this type is that the mechanism may lock up if the pivots P3, P4, P5, or P6 travel too far rearwardly. To reduce the risk of such an occurrence, the preferred embodiment of the invention avoids vertical alignment of the pivot axes. Referring to FIG. 3, it will be seen that, when the mechanism 4 is in its retracted position, the pivots P3 and P4 are positioned more forwardly than the pivots P1 and P7. Likewise, the pivots P5 and P6 are positioned more forwardly than the pivots P1 and P3.

The mechanism is self-locking in a manner known in the art. When in its extended leg-supporting position, the occupant's legs resting normally on the legrest 30 will exert a downward force which will not tend to release the mechanism to permit it to return to its stored position. However, the mechanism is unlockable if downward forces are exerted on the movable member forwardly of a given lateral vertical plane 74. Upon being unlocked, the mechanism permits movement of the movable member to its stored position.

As can be seen in FIG. 3, the furniture frame defines a cavity which lies between the sidewalls and behind the front rail. A folded mattress 76 and a folded mattress support are located in the cavity. The mattress support is preferably a sofa sleeper mechanism of the type disclosed in U.S. Pat. No. 4,592,102, although other sofa sleeper mechanisms which are well known in the art may be utilized. The mattress support and mattress are unfoldable to a position shown at 78 in order to provide a bed for sleeping. As persons familiar with the art will recognize, the legrest mechanism according to the present invention is located entirely outside the mattress cavity, so it will not take any space required of the sleeper mechanism nor interfere with its operation.

Figure 7:
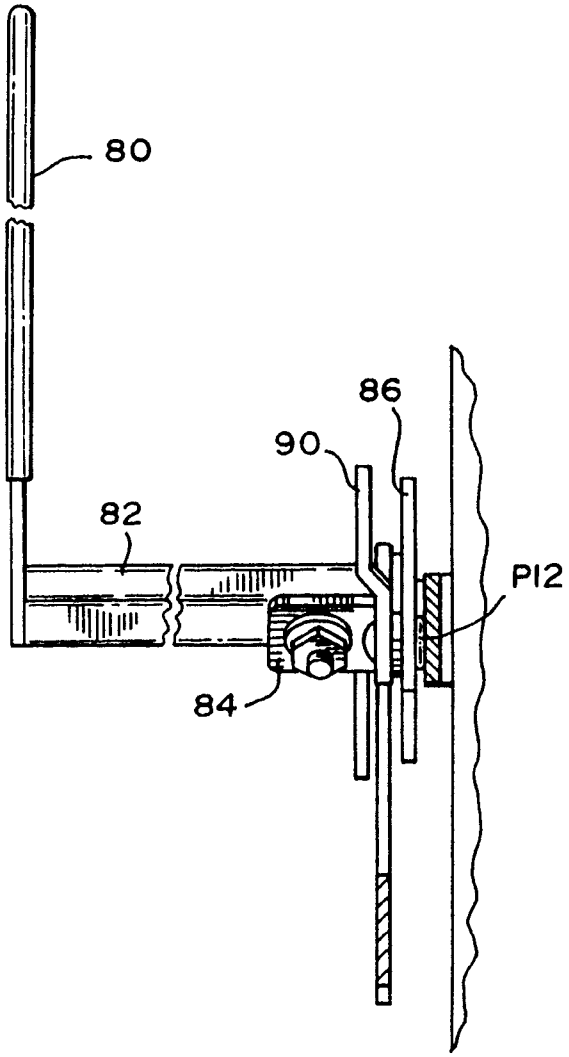
FIGS. 6 and 7 are side and front views, respectively, of a second embodiment of the invention in which the mechanism is actuated by a lever which is located outside the arm of an upholstered piece of furniture.
Figure 6:
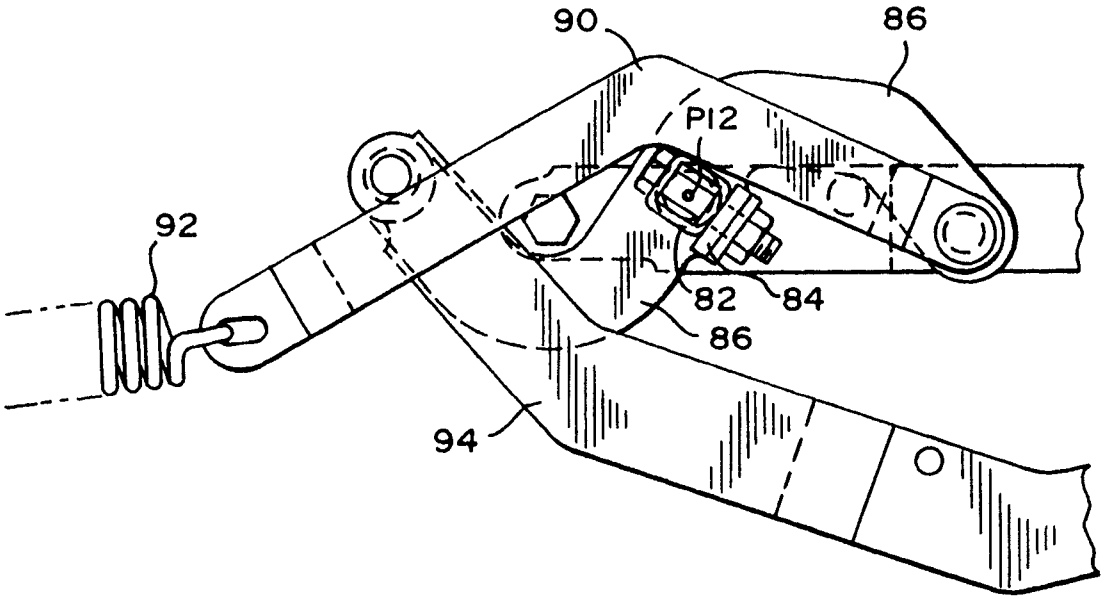

In some situations, it may be desirable to mount the actuating handle on the outside surface of an arm. An actuating mechanism for such installations is shown in FIGS. 6 and 7. The handle 80 shown in FIG. 7 is located outside the arm and it is connected to a square tube 82 which is bolted to a flange 84 on the lever 86. The lever is S-shaped and it is pivoted on the mounting bar 88 at P12. The swivel link 90 connected to the spring 92 has a dogleg profile which enables it to extend around the tube 82. When an occupant pulls rearwardly on the handle 80, the tube 82 will rotate the lever 86 about P12. When the axis of the spring 92 passes over center with respect to the pivot P12, the spring will sustain the pivotal motion of lever 86, thus moving the drive link 94 in a forward direction to extend the legrest mechanism.

Mechanisms according to the invention may be mounted differently from the positions shown in the accompanying drawings. The mounting bar 24 may be mounted on an armless side of a unit. Since armless sides are often placed beside corresponding armless sides of other units, a reconfiguration of the handle 16 is desirable to avoid the upright orientation as shown. Therefore, for lever operated mechanisms which may be located between adjacent modular or sectional seating units, the curved handle configuration shown at 16' in FIG. 3 is preferred.

Persons familiar with the field of the invention will realize that it may take many forms than those specifically described in this specification. For example, the bracket 22 may be made of two pieces which separately carry the pivots P1 and P2. The legrest bracket 28 may be formed of two members which individually carry the pivots P5 and P6. The furniture units may have varying widths and may have multiple pairs of legrest mechanisms mounted on their respective front rails. For example, a full width sofa sleeper unit may be provided with two side-by-side legrests which are individually supported and controlled.

The cavity of the furniture frame may contain eight-way tied springs or drop-in coils rather than a sofa sleeper mechanism. The legrest may be actuated by a cable actuator connected to a remote flush-mounted lever of a type known in the art. The article of furniture may have other movable components such as an independent gasoperated reclinable back.

In view of the many forms the invention may take, it is emphasized that the invention is not limited to the embodiments shown and described, but is embracing of diverse structures which fall within the spirit of the following claims.

I claim:

1. A mechanism for supporting an extendible legrest in combination with a front rail of a frame of an article of furniture, said front rail having a front surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot, said first pivot being positioned in front of the front rail;

a lower rear link pivotally connected to said fixed bracket at a second pivot which is lower than said first pivot, said second pivot being positioned under the front rail;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot.

2. A mechanism according to claim 1, said lower rear link having an upper section and a lower section, said upper section lying under the front rail when the movable member is in its stored position, said lower section being positioned more forwardly than said front rail when the movable member is in its stored position.

3. A mechanism according to claim 1 wherein said upper front link is pivotally connected to said lower rear link at a seventh pivot which is lower than said third pivot.

4. A mechanism according to claim 3, wherein said seventh pivot is located between said second and fourth pivots.

5. A mechanism according to claim 1, wherein said third and fourth pivots are positioned more forwardly than said first and seventh pivots when the movable member is in its stored position.

6. A mechanism according to claim 1, having a drive link connected to one said rear link for pivoting said one rear link in a forward direction to drive the mechanism to a position where the movable member is at its leg-supporting position.

7. A mechanism according to claim 6, wherein said drive link is connected to said lower rear link.

8. A mechanism according to claim 1, including a drive link for driving the mechanism to a position where the movable member is at its leg-supporting position, said drive link extending below said first and second pivots to permit use of the mechanism in T-cushion and armless furniture.

9. A mechanism according to claim 1, including a drive link connected to one of said links;

a spring for moving said drive link in a forward direction which drives the mechanism to a position where the movable member is at its leg-supporting position, a lever connected to said spring, said lever being movable from a locking position where it prevents said spring from driving the drive link to a releasing position where it permits said spring to move the drive link in said forward direction.

10. A mechanism according to claim 9, including manually operated means for moving said lever from its locking position to its releasing position.

11. A mechanism according to claim 10, wherein said manually operated means includes a handle which is movable through a given angle of travel, a lost motion connection between said handle and said lever whereby said handle moves said lever during only a portion of said given angle of travel.

12. A mechanism according to claim 1, including a handle operably connected to the mechanism and which is manually operable to drive the mechanism to a position where the movable member is at its leg-supporting position.

13. A mechanism according to claim 1, including a mounting bar which extends rearwardly from said fixed bracket, a drive link connected to one of said links, a lever for moving said drive link, said lever being operatively connected to the drive link and being pivotally mounted on said mounting bar, said drive link entirely being lower than said first pivot.

14. The combination of claim 1, wherein said frame defines a cavity; a folded mattress and a folded mattress support in said cavity, said mattress support and said mattress being unfoldable to provide a bed for sleeping.

15. A mechanism according to claim if said mechanism being locked in its leg-supporting position to prevent downward movement of said movable member when downward forces are exerted on said movable member rearwardly of a given vertical plane; said mechanism being unlockable in response to downward forces exerted on said movable member forwardly of said given vertical plane to permit movement of said movable member to its stored position.

16. An upholstered piece of furniture having a front rail and a mechanism for supporting an extensible legrest, said front rail having surface and a bottom surface, said mechanism including the following:

a fixed bracket which is mountable on said frame near said front surface, a movable member on which a legrest is mountable said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot which is located in front of said front surface;

a lower rear link pivotally connected to said bracket at a second pivot which is located under said bottom surface;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot,

17. An upholstered piece of furniture including a frame which includes a front rail having a front surface and a bottom surface two mechanism for supporting an extendible legrest and a laterally extending torsion member connecting said two mechanism so they extend and retract together, each of said mechanisms including the following:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot and which is located under said bottom surface;

a lower rear link pivotally connected to said fixed bracket at a second pivot which is lower than said first pivot and which is located under said bottom surface;

an upper front link pivotally connected to said Upper rear link at a third pivot;

a lower front link pivotally connected to said rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot.

18. An upholstered piece of furniture according to claim 17, said torsion member being located under said bottom surface when the mechanisms are in their retracted positions.

19. A mechanism for supporting an extendible legrest in combination with a front rail of a frame of an article of furniture, said front rail having a front surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot which is positioned in front of the front rail;

a lower rear link pivotally connected to said fixed bracket at a second pivot which is lower than said first pivot said second pivot being positioned under the front rail;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said upper front link being pivotally connected to said lower rear link at a seventh pivot which is lower than said third pivot.

20. A mechanism according to claim 19, wherein said seventh pivot is located between said second and fourth pivots.

21. A mechanism according to claim 20, said lower rear link having an upper section and a lower section, said upper section lying under the front rail when the movable member is in its stored position, said lower section being positioned more forwardly than said front rail when the movable member is in its stored position.

22. A mechanism according to claim 20, wherein said third and fourth pivots are positioned more forwardly than said first and seventh pivots when the movable member is in its stored position.

23. A mechanism according to claim 20, having a drive link connected to one said rear link for pivoting said one rear link in a forward direction to drive the mechanism to a position where the movable member is at its leg-supporting position.

24. A mechanism according to claim 23, wherein said drive link is connected to said lower rear link.

25. A mechanism according to claim 20, including a drive link for driving the mechanism to a position where the movable member is at its leg-supporting position, said drive link extending below said first and second pivots to permit use of the mechanism in armless and T-cushion furniture.

26. A mechanism according to claim 20, including a drive link connected to one of said links;

a spring for moving said drive link in a forward direction which drives the mechanism to a position where the movable member is at its leg-supporting position, a lever connected to said spring, said lever being movable from a locking position where it prevents said spring from driving the drive link to a releasing position where it permits said spring to move the drive link in said forward direction.

27. A mechanism according to claim 26, including manually operated means for moving said lever from its locking position to its releasing position.

28. A mechanism according to claim 27, wherein said manually operated means includes a handle which is movable through a given angle of travel, a lost motion connection between said handle and said lever whereby said handle moves said lever during only a portion of said given angle of travel.

29. A mechanism according to claim 20, including a handle operably connected to the mechanism and which is manually operable to drive the mechanism to a position where the movable member is at its leg-supporting position.

30. A mechanism according to claim 20, including a mounting bar which extends rearwardly from said fixed bracket, a drive link connected to one of said links, a lever for moving said drive link, said lever being operatively connected to the drive link and being pivotally mounted on said mounting bar, said drive link entirely being lower than said first pivot.

31. The combination of claim 21, wherein said frame defines a cavity; a folded mattress and a folded mattress support in said cavity, said mattress support and said mattress being unfoldable to provide a bed for sleeping.

32. A mechanism according to claim 20, said mechanism being locked in its leg-supporting position to prevent downward movement of said movable member when downward forces are exerted on said movable member rearwardly of a given vertical plane; said mechanism being unlockable in response to downward forces exerted on said movable member forwardly of said given vertical plane to permit movement of said movable member to .its stored position.

33. An upholstered piece of furniture including a frame and a mechanism for supporting an extensible legrest, said frame including a front rail which has a front surface and a bottom surface, said mechanism including the following:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot which is in front of the front surface;

a lower rear link pivotally connected to said fixed bracket at a second pivot which is lower than said first pivot, said second pivot being located under said bottom surface;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said upper front link being pivotally connected to said lower rear link at a seventh pivot which is lower than said third pivot.

34. An upholstered piece of furniture comprising a frame with a front said front rail having a front surface, said furniture including two mechanisms for supporting an extendible legrest, and a laterally extending torsion member connecting said two mechanisms so they extend and retract together, each of said mechanisms including the following:

a fixed bracket which is mounted on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot which is positioned in front of said front rail;

a lower rear link pivotally connected to said fixed bracket at a second pivot which is lower than said first pivot, said second pivot being positioned under said front rail;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said upper front link being pivotally connected to said lower rear link at a seventh pivot which is lower than said third pivot.

35. An upholstered piece of furniture according to claim 34, wherein said front rail which has a bottom surface, said torsion member being located under said bottom surface when the mechanisms are in their retracted positions.

36. An upholstered piece of furniture, comprising, a) a frame which includes a front rail which has a bottom surface;

b) an extendible legrest;

c) two mechanisms which each are movable between a retracted position and an extended position, each of said mechanisms including:

a fixed bracket which is mounted on said frame near said front rail;

a movable member on which said legrest is mounted, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot which is positioned in front of the front rail;

a lower rear link pivotally connected to said fixed bracket at a second pivot which is lower than said first pivot, said second pivot being positioned under the front rail;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

d) a laterally extending torsion member connecting said two mechanisms so they extend and retract together, said torsion member being located under said bottom surface of the front rail when the mechanisms are in their retracted positions.

37. A piece of furniture according to claim 36 wherein, in each said mechanism, said upper front link is pivotally connected to said lower rear link at a seventh pivot which is lower than said third pivot.

38. A piece of furniture according to claim 37 wherein, in each said mechanism, said seventh pivot is located between said second and fourth pivots.

39. A furniture frame and a mechanism for supporting an extendible legrest on an article of furniture, said frame including a front rail which has a front surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot;

a lower rear link pivotally connected to said fixed bracket at a second pivot which is lower than said first pivot, said lower rear link having an upper section and a lower section, said upper section lying under the front rail when the movable member is in its stored position, said lower section being positioned more forwardly than said front rail when the movable member is in its stored position;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot.

40. A mechanism for supporting an extendible legrest on an article of furniture which has a frame which includes a front surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot;

a lower rear link pivotally connected to said fixed bracket at a second pivot which is lower than said first pivot;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot;

said third and fourth pivots being positioned more forwardly than said first and seventh pivots when the movable member is in its stored position.

41. An upholstered piece of furniture having a frame and a mechanism for supporting an extendible legrest, said frame having a front rail which has a front surface and a bottom surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot, said first pivot being located in front of said front surface;

a lower rear link pivotally connected to said fixed bracket at a second pivot which is lower than said first pivot, said second pivot being located under said bottom surface;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said first pivot being positioned more forwardly than said second pivot.

42. A furniture frame and a mechanism for supporting an extendible legrest on an article of furniture, said frame having a front rail which includes a front surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot;

a lower rear link pivotally connected to said fixed bracket at a second pivot which is lower than said first pivot, said lower rear link having an upper section and a lower section, said upper section lying under the front rail when the movable member is in its stored position, said lower section being positioned more forwardly than said front rail when the movable member is in its stored position;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said upper front link being pivotally connected to said lower rear link at a seventh pivot which is lower than said third pivot.

43. A mechanism for supporting an extendible legrest on an article of furniture, said frame including a front rail which has a front surface and a bottom surface, said mechanism being movable between a retracted position and an extended position, said mechanism comprising:

a fixed bracket which is mountable on said frame near said front surface, a movable member on which a legrest is mountable, said movable member being in a substantially vertical stored position near the fixed bracket when the mechanism is in its retracted position, said movable member being in a generally horizontal leg-supporting position spaced from the fixed bracket when the mechanism is in its extended position;

an upper rear link pivotally connected to said fixed bracket at a first pivot, said first pivot being in front of said front surface;

a lower rear link pivotally connected to said fixed bracket at a second pivot which is lower than said first pivot, said second pivot being located under said bottom surface;

an upper front link pivotally connected to said upper rear link at a third pivot;

a lower front link pivotally connected to said lower rear link at a fourth pivot which is lower than said third pivot;

said movable member being connected to the upper front link at a fifth pivot and being connected to the lower front link at a sixth pivot, said sixth pivot being lower than said fifth pivot when the movable member is at its stored position;

said links having profiles which overlap lengthwise and are generally vertical when the mechanism is in its retracted position;

said upper front link being pivotally connected to said lower rear link at a seventh pivot which is lower than said third pivot.

* * * * *